United States Patent [19]

Smith

[11] 4,257,173

[45] Mar. 24, 1981

[54] NO-HEAT CLOTHES DRYER

[76] Inventor: Derrick A. Smith, 1180 S. Seabreeze Blvd., Ft. Lauderdale, Fla. 33316

[21] Appl. No.: 70,328

[22] Filed: Aug. 27, 1979

[51] Int. Cl.[3] ..... F26B 13/30; F26B 19/00

[52] U.S. Cl. ..... 34/92; 34/202; 432/250

[58] Field of Search ..... 34/92, 202; 432/205, 432/250; 266/250

[56] References Cited

U.S. PATENT DOCUMENTS

| | | | |
|---|---|---|---|
| 3,144,035 | 8/1964 | Hablanian et al. | 34/92 |
| 3,399,875 | 9/1968 | Ipsen | 34/92 |
| 3,550,284 | 12/1970 | Lambert | 34/92 |

*Primary Examiner*—John J. Camby

[57] ABSTRACT

A "no-heat" clothes dryer is provided herein. It includes a drying chamber having an access opening. An access door is hinged to the access opening, the door being adapted to close the access opening in an hermetically sealed manner. Means, which are conventional but which are adapted to be actuated only when the door is closed, are provided to subject the interior of the drying chamber to a vacuum. Means are provided which positively interrelate the breaking of the vacuum with the opening of the access door. Such means include a door handle having a lever which is pivotally mounted to move between a closed position, where it locks the door in a closed position, and an open position, where it simultaneously opens vents to the interior of the drying chamber and unlocks the door to enable opening thereof. The particular structure of the door handle is as follows: (i) a main framework; (ii) an anchor plate at one corner thereof; (iii) a release lever pivotally secured to the anchor plate; (iv) a plunger extending through the door, and connected to the free end of the release lever normally resiliently urged to come into locking engagement with a lock on the door frame; and (v) means associated with the movement of the plunger out of locking engagement with the lock to open vent means in the door. In this way, clothes are dried without the expenditure of wasteful heat energy in a home dryer which includes a fail-safe safety feature for the door opening.

3 Claims, 2 Drawing Figures

NO-HEAT CLOTHES DRYER

BACKGROUND OF THE INVENTION

1. Field of the Invention

This invention relates to a clothes dryer which is adapted to dry clothes without the addition of heat.

2. Description of the Prior Art

It is well known that clothes may be dried by the application of heat thereto in electrically-heated or gas-heated clothes dryers. Not only is there a considerable expenditure of energy required to heat the clothes to a sufficiently high temperature that the clothes will dry, but the heat in the exhaust from such dryers is lost. Moreover, since these dryers tumble the clothes, the clothes, when they are removed, are wrinkled and generally must be ironed.

It is well known that the boiling point of a liquid is decreased with a decrease in ambient pressure. This well-known thermodynamic fact has been applied in many patents. For example, in Canadian Pat. No 322,144 issued May 3, 1932 to W. Muller et al, an apparatus is provided to assist in the preparation of bread. The apparatus includes a vacuum chamber having one or more air-tight and lockable access doors therein with means for supporting freshly baked bread within the chamber. A condenser is connected to the chamber and a vacuum pump is coupled to the condenser. Drainage and control means are connected to the chamber and to the condenser. A pressure release valve and a vacuum indicating gauge are also connected to the chamber.

In another patent, Canadian Pat. No. 372,845 issued Mar. 30, 1938 to W. L. Fleisher, an apparatus is provided for cooling bread. The apparatus includes a plurality of chambers, each having closure means and means for the automatic locking thereof. A vacuum pump is provided, along with distributor means for automatically connecting and disconnecting the pump with the chambers in timed relation and for breaking the vacuum in the chambers without affecting the operation of the pump.

SUMMARY OF THE INVENTION

Aims of the Invention

Thus, while these patents taught the drying of a material, e.g. bread, using a vacuum chamber and while they appreciated the necessity of breaking the vacuum, there was no teaching of means positively. interrelating the breaking of the vacuum with the opening of the doors. Such means is a valuable safety factor for a home-use dryer as distinct from an industrial dryer.

Consequently, an object of [a broad aspect of] this invention is the provision of a clothes dryer which dries clothes by vacuum without the use of heat and including means positively interrelating the breaking of the vacuum with the opening of the access door.

STATEMENT OF THE INVENTION

By one broad aspect of this invention, then, a no-heat clothes dryer is provided comprising: (a) a drying chamber having an access opening; (b) an access door to the drying chamber, the door being adapted to close the access opening in an hermetically sealed manner; (c) means, adapted to be actuated only when the door is closed, to subject the interior of the drying chamber to a vaccum; and (d) means positively interrelating the breaking of the vacuum with the opening of the access door, the means comprising a door handle including a lever which is pivotally mounted to move between a closed position, where it locks the door in a closed position, and an open position, where it simultaneously opens vents to the interior of the drying chamber, thereby to break the vacuum, and unlocks the door to enable opening thereof; the door handle comprising (i) a main framework; (ii) an anchor plate at one corner thereof; (iii) a release lever pivotally secured to the anchor plate; (iv) a plunger extending through the door, and connected to the free end of the release lever normally resiliently urged to come into locking engagement with a lock on the door frame; and (v) means associated with the movement of the plunger out of locking engagement with the lock to open vent means in the door.

OTHER FEATURES OF THE INVENTION

By a feature thereof, the perimeter of the access opening is provided with one-half of a magnetic gasket, and the perimeter of the door is provided with a cooperating one-half of a magnetic gasket.

By yet another feature, the clothes dryer includes hooks within the drying chamber for the hanging of clothes to be dried.

GENERAL DESCRIPTION

Thus, by the present invention in one of its embodiments, a "no-heat" clothes dryer is provided, the drying being achieved by a decrease in pressure. To achieve this according to one embodiment of this invention, an enclosed space is provided with a vacuum pump to facilitate the creation of a partial vacuum in the interior. With the vacuum unit, the pressure of the cabinet will be reduced substantially after the clothes are put in. Although this will use a minute fraction of the energy required for the heating and air blowing of the conventional type, it will efficiently dry the clothes without tumbling, which also reduces or nullifies the energy and time required for pressing.

BRIEF DESCRIPTION OF THE DRAWINGS

In the accompanying drawing.

DESCRIPTION OF PREFERRED EMBODIMENT

Figure 1:
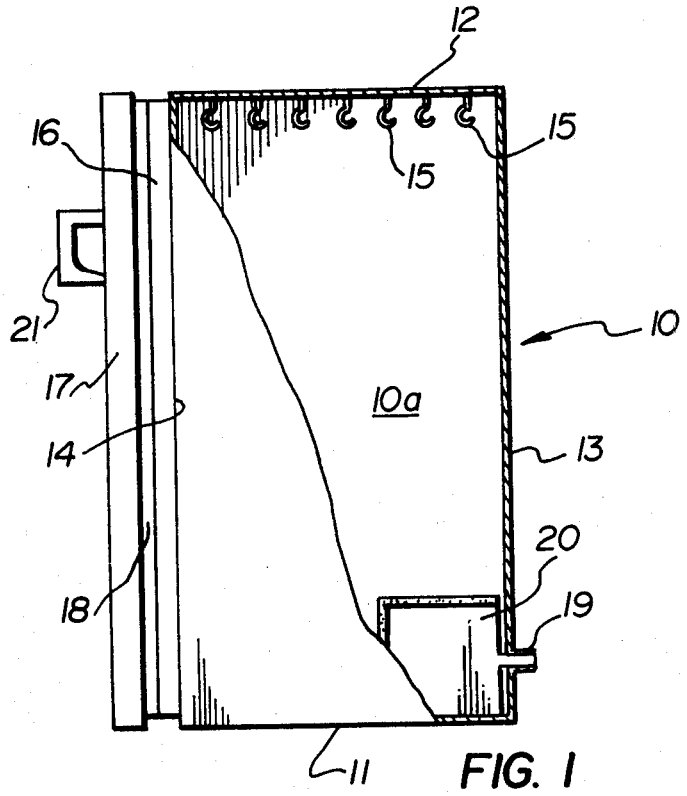
FIG. 1 is a vertical cross-sectional upright view of the clothes dryer of an aspect of this invention.

Description of FIG. 1

As seen in FIG. 1, the clothes dryer 10 is a generally rectangular parallelepiped box 10*a* including top 11, bottom 12, back 13 and an access opening 14. Secured to the top 11 is a plurality of hooks 15 by which clothes to be dried may be hung up on hangers. Extending around the perimeter of the access opening 14 is one-half of a magnetic gasket 16.

A door 17 is provided which is hinged to the access opening 14 in the usual manner (not shown). Extending around the perimeter of the door 17 is the mating half of a magnetic gasket 18, in order that the door 17 when closed, closes the clothes dryer 10 in an hermetic manner.

The exhaust 19 is connected to a source of vacuum. As shown in FIG. 1, the source of vacuum is provided by a vacuum pump 20 disposed within the box 10*a*.

DESCRIPTION OF FIG. 2

Figure 2:
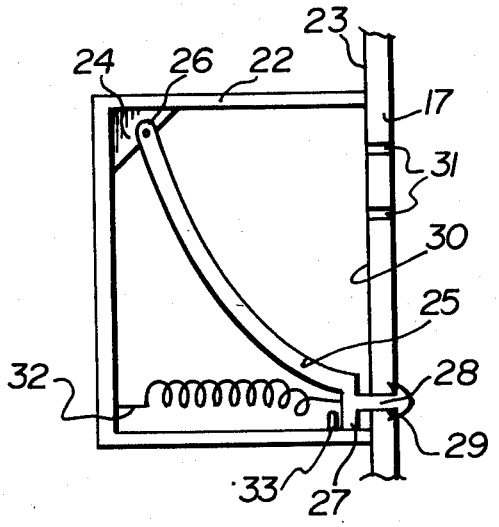
FIG. 2 is a vertical cross-sectional view of the door and lock mechanism of the clothes dryer of an aspect of this invention.

As shown in FIG. 2, a door handle 21 is provided which positively interrelates the breaking of the vacuum with the opening of the access door 17. The handle 21 includes a framework 22 secured to the outside face 23 of the door 17. An anchor plate 24 is provided at the upper left hand corner of the handle frame, to which is pivotally mounted a release lever 25 by a pin 26. The lower end of the release lever is provided with a guide leg 27 and a locking plunger 28 extending through an aperture 29 in the door 17 to permit locking engagement with a lock (not shown) on the frame of access opening 14. Secured within the handle frame is a closure plate 30 which normally closes vent holes 31 but, when the plunger 28 is withdrawn from aperture 29, is drawn away from vent holes 31. Plunger 28 is urged to locking engagement by compression spring 32. The withdrawing movement of the plunger is stopped by stopper 33.

OPERATION OF PREFERRED EMBODIMENT

In use, the clothes to be dried are placed in the drying chamber 10*a*. If the wet clothes are of a nature to be hung on a hanger, they are so hung and then the hanger is hung on the hooks 15. The access door is closed and, when so closed, conventional means (not shown) then permit the vacuum pump 20 to be actuated to place the drying chamber 10*a* under vacuum.

After a predetermined period of time, the clothes are dried. The vacuum pump is turned off. The handle is grasped by the release lever. Movement of the release lever pulls the plunger out of locking engagement, opens vent holes 31 to break the vacuum and enables the door 17 to be opened.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A "no-heat" clothes dryer comprising:

(a) a drying chamber having an access opening;

(b) an access door to said drying chamber, said door being adapted to close said access opening in an hermetically sealed chamber;

(c) means, adapted to be actuated only when said door is closed, to subject the interior of said drying chamber to a vacuum; and (d) means positively interrelating the breaking of the vacuum with the opening of said access door, said means comprising a door handle including a lever which is pivotally mounted to move between a closed position where it locks the door in a closed position and an open position where it simultaneously opens vents to the interior of the drying chamber thereby to break said vacuum, and unlocks the door to enable opening thereof; said door handle comprising:

(i) a main framework;

(ii) an anchor plate at one corner thereof;

(iii) a release lever pivotally secured to said anchor plate;

(iv) a plunger extending through said door, and connected to the free end of said release lever normally resiliently urged to come into locking engagement with a lock on said door frame; and (v) means associated with the movement of said plunger out of locking engagement with said lock to open vent means in said door.

2. The clothes dryer of claim 1 wherein the perimeter of said access opening is provided with one-half of a magnetic gasket, and wherein the perimeter of the door is provided with a cooperating one-half of a magnetic gasket.

3. The clothes dryer of claim 1 including hooks within the drying chamber for the hanging of clothes to be dried.

* * * * *